US005515662A

United States Patent [19]

Johnstone

[11] Patent Number: 5,515,662

[45] Date of Patent: May 14, 1996

[54] BULK PACKAGING SYSTEM

[75] Inventor: Peter Johnstone, Victoria, Australia

[73] Assignee: First Green Park Pty Ltd., Victoria, Australia

[21] Appl. No.: 356,203

[22] PCT Filed: Jul. 20, 1993

[86] PCT No.: PCT/AU93/00365

§ 371 Date: Dec. 19, 1994

§ 102(e) Date: Dec. 19, 1994

[87] PCT Pub. No.: WO94/02358

PCT Pub. Date: Feb. 3, 1994

[30] Foreign Application Priority Data

Jul. 21, 1992 [AU] Australia ..... PL3714

[51] Int. Cl.[6] ..... B65B 35/00

[52] U.S. Cl. ..... 53/441; 53/399; 53/456; 53/449

[58] Field of Search ..... 53/399, 449, 410, 53/413, 441, 456, 459, 173, 447

[56] References Cited

U.S. PATENT DOCUMENTS

| | | | |
|---|---|---|---|
| 3,809,223 | 5/1974 | Kendall | 53/449 |
| 4,454,705 | 6/1984 | Benno | 53/399 |
| 4,546,593 | 10/1985 | Lasscock | 53/441 |
| 4,593,517 | 6/1986 | Mattila | 53/441 |
| 4,924,654 | 5/1990 | Langer et al. | 53/456 |
| 5,056,571 | 10/1991 | Derby . | |
| 5,317,851 | 6/1994 | Lang et al. | 53/449 |

FOREIGN PATENT DOCUMENTS

| | | | |
|---|---|---|---|
| 2448720 | 4/1975 | Germany | 53/449 |

*Primary Examiner*—John Sipos
*Assistant Examiner*—Ed Tolan
*Attorney, Agent, or Firm*—Bell, Seltzer, Park & Gibson

[57] ABSTRACT

A system for forming a container (21) suitable for storage of flowable or non-flowable material, comprising the steps of forming an open container of flexible material having walls and a closed bottom with a retractable or removable framework (11) therein; at least partially filling the container (21) with material; removing or retracting said framework (11) from said container (21); closing the container (21); and subsequently over-wrapping the closed container (21) with stretch plastic film (16) to form reinforcing strips to reinforce the container (21), and to allow engagement with handling apparatus such as the forks of a lift truck.

5 Claims, 3 Drawing Sheets

BULK PACKAGING SYSTEM

The present invention relates to the packaging of articles of any kind particularly flowable granules, powders or liquids.

The method or methods of the invention may be incorporated into fully automated packaging lines.

The invention is useful in the packaging of flowable granules such as plastic granules, cereals, powders such as fertilisers or liquids as well as for baling of waste materials with only minor modification being required. Materials of all kinds including industrial, commercial and domestic waste materials are currently handled in a variety of ways including use of plastic bags which are difficult to handle if they are to be subject to exposure to liquids and/or compacting of contents and includes intermediate bulk containers which are usually filled with material such as fertilisers, cereal or plastic granules. Furthermore such bags tend to be expensive and do not lend themselves to recycling procedures.

A packaging system of the present type has already been disclosed in our co-pending International Patent Application No. PCT/AU92/00142 which is hereby incorporated herein by cross reference.

The present invention has as its objective to provide a bulk package and packaging system in which the need for a solid base member or conventional pallet base is dispensed with and the package can be handled by normal handling machinery and methods.

There is provided according to the present invention a method of forming a bulk container comprising the steps of forming an open container of flexible material having walls and a closed bottom with a retractable or removable framework therein, at least partially filling the container with material, removing or retracting said framework from said container, closing the container, and subsequently over wrapping the closed container with stretch plastic film to form reinforcing strips to reinforce the container and allow engagement with handling apparatus such as the fork of a lift truck.

In a further aspect of the present invention there is provided a method of forming a container comprising the steps of forming an open chamber of flexible material having walls and a closed bottom with a retractable or removable framework therein acting to maintain the container volume open, at least partially filling the container with material, removing or retracting said framework from said container, wrapping said container and a spacer means with flexible material to reinforce said container and secure said spacer means, said spacer means being arranged and adapted to allow engagement with a load handling apparatus.

A reinforcing stretch film is preferably wrapped circumferentially around the container end to end to form a right angular cross pattern. To assist engagement with the fork or forks of a lift truck a rigid spacer member(s) is (are) provided at either end of the container between the end of the container and the reinforcing wrap. Thus with the spacer at the top of the container, the container can be transported by a lift truck suspended from the tine of the lift truck or resting on the tine with the spacers at the bottom of the container.

It has been found that the container formed in accordance with the invention will assume a substantially rectangular cubic configuration which is conveniently stackable in the manner of a conventional rectangular cubic bag container without danger of the contents of the container slipping or moving.

The invention is conveniently used in association with a packaging system disclosed in our above-referred to patent application, however, it can be utilised with conventional pre-formed plastic bag systems and overcomes the problem inherent in such systems in retaining a substantially rectangular cubic configuration. Furthermore in conventional bag systems flowable contents such as liquids or granules do tend to shift and the present invention is adapted to overcome this difficulty.

The invention may be used with or without a support base. A support base is not essential if a rigid spacer is provided at the top or the bottom of the bag to accept the fork of lift truck equipment.

The invention will be described in greater detail with reference to the accompanying drawings in which.

Figure 2:
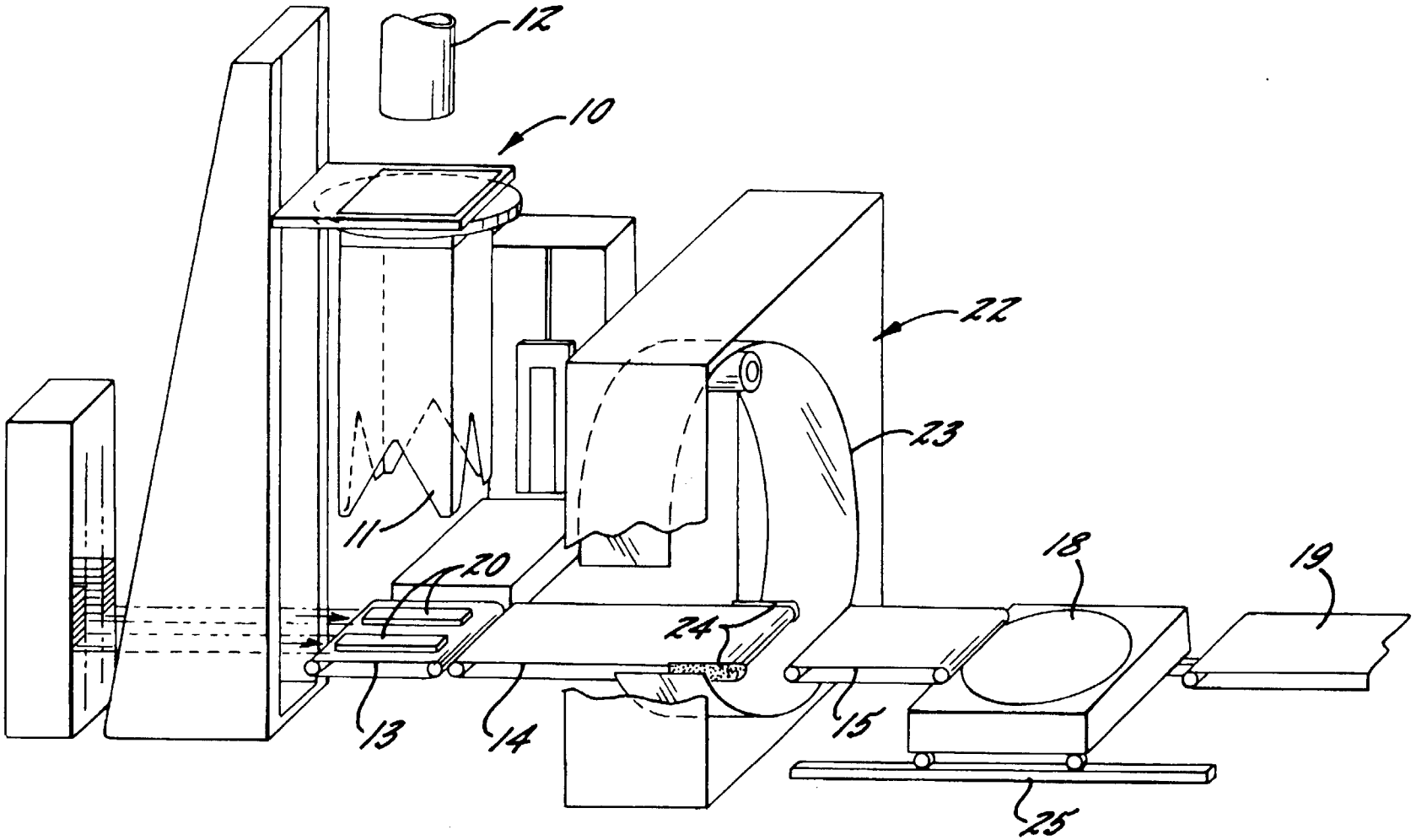
FIG. 2 shows schematically a system of formation of a container and conveyance according to the invention.
Figure 2A:
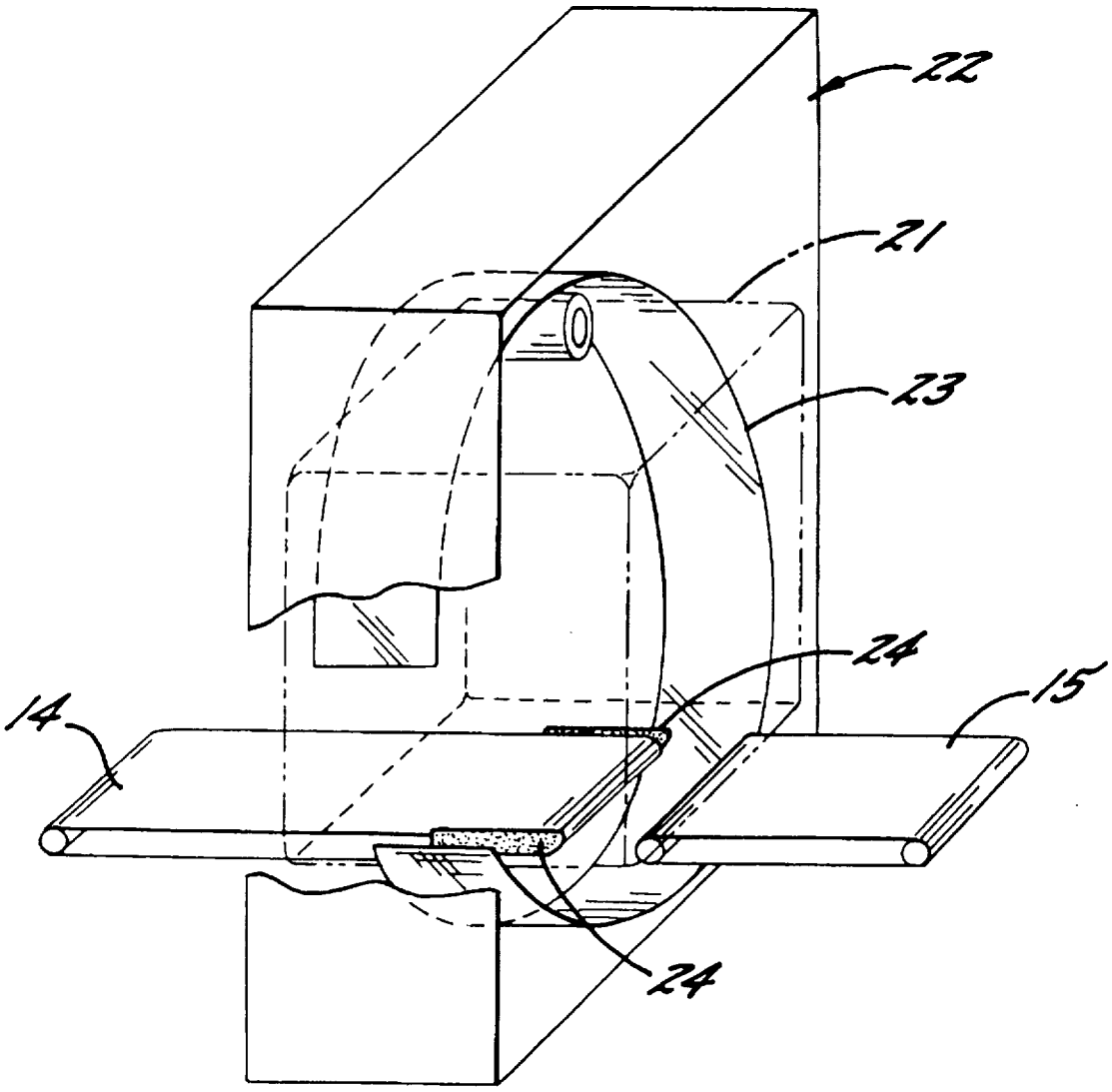
FIG. 2A is a partial perspective view of the reinforcing wrapping step according to the present invention.

With reference to FIGS. 2 and 2A the container is formed at the station 10 and filled with material and the frame removed in accordance with procedures as disclosed in our earlier patent application No. PCT/AU92/00142 referred to above wherein stretch plastic film is wrapped around a removable or retractable frame 11 to form a walled container. The container is preferably solely constructed of the plastic film with the retractable/removable frame 11 and conveyor 13 being its sole means of support during a filling operation.

The container is formed by wrapping the frame with several layers of stretch plastic film including over wrapping at the base of the frame 11. The film is applied at up to 300% elongation of the film so that the film contracts inwardly to form a base that can be easily closed as by tying or welding. In one embodiment of the invention the frame with its wrapping is then rested on a conveyor 13 upon which is placed a pair of spacer members 20. At this time the formed container may be filled with any suitable material but including any flowable material such as granules, powder or liquid. The size of the container is preferably of a standard size of approximately 1000 kilograms. This weight may be varied according to individual requirements.

After filling the container from filler nozzle 12 the container is self supporting and the frame is adapted to be removed/retracted from the top of the container and the container closed off at the top. The weight of the container and contents is sufficient to remain in its rest position on the conveyor 13 whilst the frame 11 is removed or retracted from the container.

The container may be constituted by a strong plastic bag rather than formed by stretch plastic film and the bag is supported or held open in its empty condition by a removable frame structure which may be in the same form as is used in the container formed by wrapped film material.

After closing the top of the container 21 the container mounted on spacer elements 20 is moved on to a conveyor 14 operating in conjunction with a tubular film wrapping station 22 which may be of the same general type as disclosed in U.S. Pat. No. 4,079,565 in which plastic stretch film is dispensed from an orbiting stretch film dispenser apparatus.

The stretch film is wrapped first around the container to form a single band 16 extending end to end around the container over the spacer members 20. The container is then moved on to a turntable 16 and turn through 90° and returned to the wrapping station 22 wherein the second band 17 is applied to the container to form the cross-wrapping as best shown in FIG. 1 with the spacer members 20 securely fixed to the bottom of the container.

With specific reference to FIG. 2A the conveyor 14 is provided with fixed slide members 24 at each side, preferably coated with anti-friction material such as a non-stick coating or suitable lubricant to facilitate sliding of the reinforcing plastic layer 23 therefrom after a wrapping step forming a reinforcing layers 16 and 17 on the container. The space between the conveyors 14, 15 is set at approximately one half of the width of the plastic film 23 so that approximately one half of the film width is actually contacting the slide members 24 and the other half is directly contacting the container wall. After tightly wrapping the film 23 to the filled container 21 the process is repeated after rotation of the container 21 through 90°.

Figure 1:
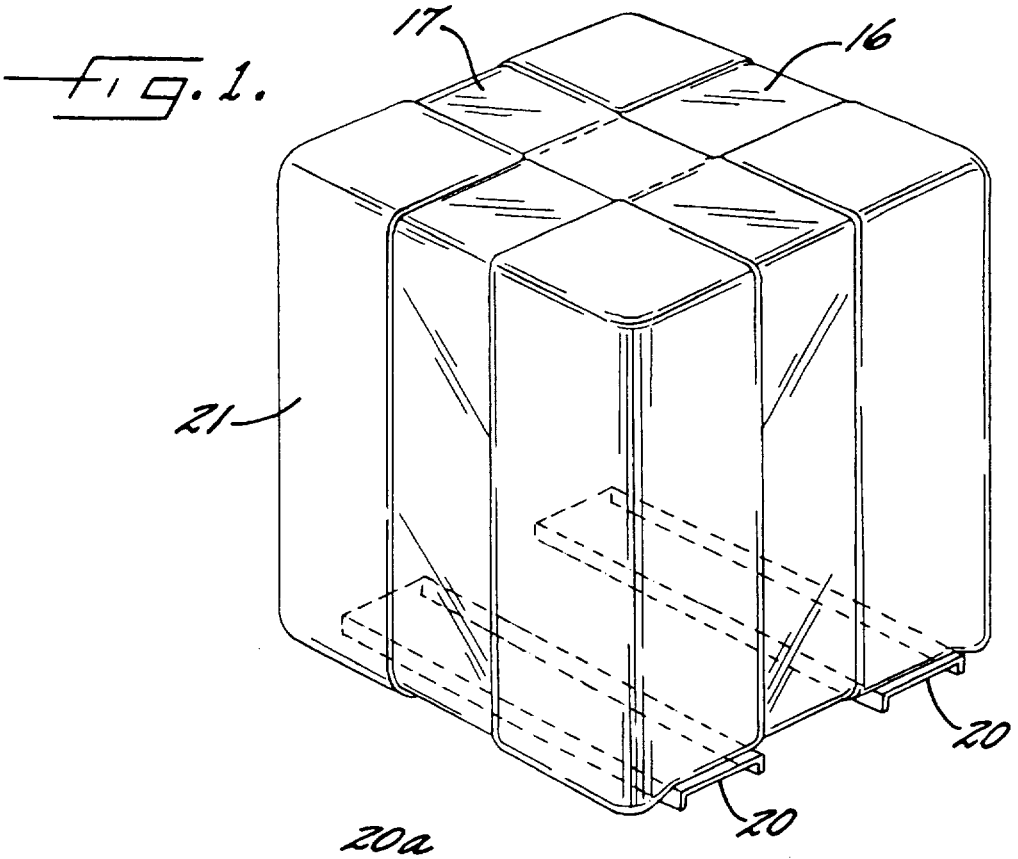
FIGS. 1 and 1A are perspective views of a container formed according to the invention.
Figure 1A:
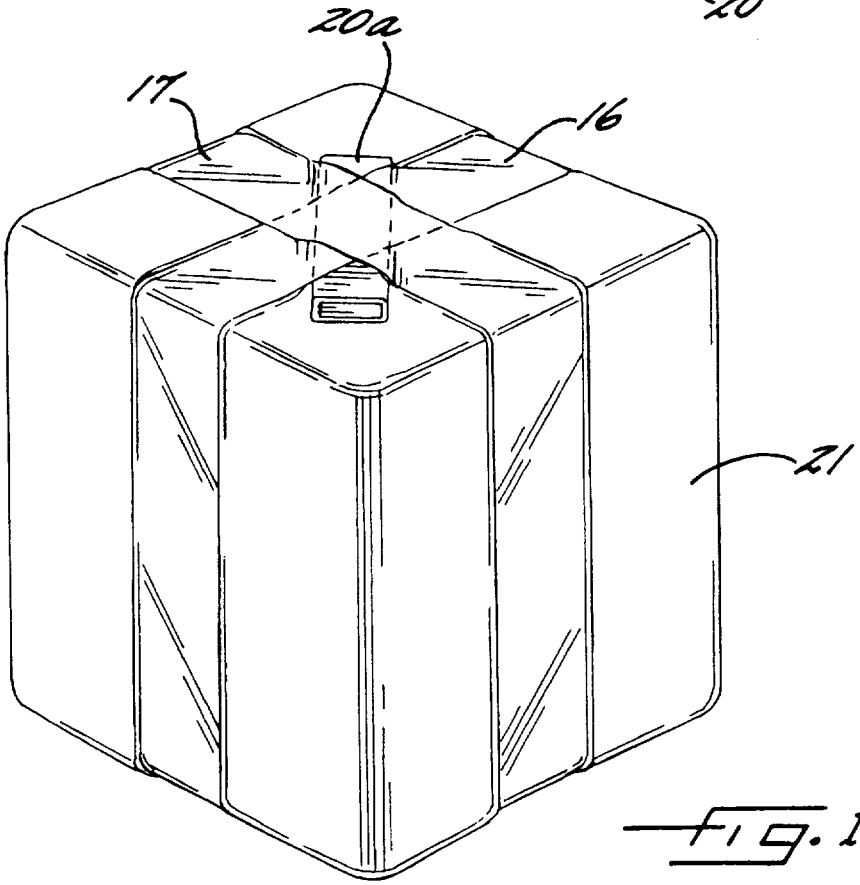

The film slides off into the gap between the conveyors 14 and 15 due to its inherent tightness under tension to closely envelop the container as shown in FIGS. 1 and 1A. A container can then be moved to the conveyor 17 for handling by conventional handling equipment such as a fork lift truck either by lifting by insertion of the fork lift tines into the spacer member 20 shown at FIG. 1 or the insertion of the fine into the spacer member 20*a* as shown in FIG. 1A.

To achieve movement of the container from the turntable the turntable is mounted on a hoist (not shown) and is movable on a track 25 relative to conveyors 15 and 17 to enable transfer of the loaded container from and to the conveyors 15 and 17 and the turntable.

With specific reference to FIG. 1A a rigid spacer member 20*a* is positioned on top of the filled container and is secured in position shown by over wrapping of the container by the reinforcing strips 16, 17 in similar fashion to that described previously.

It has been surprisingly found that the wrapping of the container as shown ensures that the overall configuration of the container substantially conforms to that of a rectangular cubic construction as shown in FIGS. 1 and 1A and can be easily stacked in container transport or for any long distance transport.

I claim:

1. A method of forming a bulk package for flowable liquid, powder, granules and solid material, comprising the steps of:

providing an open frame defining an open space having a volume approximating the volume of said package and said open frame adapted to form a closed bottom end for said package;

applying stretch plastic wrapping film in a stretched condition around said open frame to form a container with a closed bottom end and open at its top end with the frame in place;

filling the container through said top endear least partially with said material to form a package;

removing or retracting said frame from said package after at least partially filling of said container;

closing the top end of said package to form, a totally closed package in which the plastic wrapping film alone forms said container;

positioning spacer means on the container of said package; and overwrapping the closed package and spacer means with stretch plastic film to form reinforcing strips around the package with spacer means to allow engagement with handling apparatus such as the tines of a forklift truck.

2. A method of forming a bulk package for flowable liquid, powder, granules and solid material, comprising the steps of:

providing an open frame defining an open space having a volume approximating the volume of said package and said open frame adapted to form a closed bottom end for said package;

applying plastic wrapping film under tension around said open frame to form a tight walled container with a closed bottom end and open at its top end with the frame in place;

filling the container through said top end at least partially with said material to form a package;

removing or retracting said frame from said package after at least partially filling of said container;

closing the top end of the said package to form a totally closed package in which the plastic wrapping film alone forms said container;

positioning spacer means on the container of said package; and overwrapping the closed package and spacer means with stretch plastic film to form reinforcing strips around the package with spacer means to allow engagement with handling apparatus such as the tines of a forklift truck.

3. A method as claimed in claim 1 wherein the plastic film is wrapped circumferentially around the package end to end to form a right angular cross pattern.

4. A method as claimed in claim 1 or 2 wherein the spacer means is provided at either a top or bottom end of the package between the end of the package and the reinforcing wrap.

5. A package made by the method as claimed in any of claims 1, 3 or 2.

* * * * *

UNITED STATES PATENT AND TRADEMARK OFFICE

CERTIFICATE OF CORRECTION

PATENT NO. : 5,515,662

DATED : May 14, 1996

INVENTOR(S) : Peter Johnstone

It is certified that error appears in the above-identified patent and that said Letters Patent is hereby corrected as shown below:

IN THE CLAIMS:

Column 4, line 1, "endear" should be -- end at --.

Column 4, line 5, after "form" omit the comma (,).

Signed and Sealed this

Sixteenth Day of July, 1996

*Attest:*

*Attesting Officer*

BRUCE LEHMAN

*Commissioner of Patents and Trademarks*